US008691906B2

(12) United States Patent
Völkel et al.

(10) Patent No.: US 8,691,906 B2
(45) Date of Patent: Apr. 8, 2014

(54) METHOD FOR PRODUCING AN MONOFILAMENT AND USE OF THE MONOFILAMENT

(75) Inventors: Mark Völkel, Ladenburg (DE); Rebekka von Benten, Ludwigshafen (DE); Sachin Jain, Mannheim (DE)

(73) Assignee: BASF SE, Ludwigshafen (DE)

( * ) Notice: Subject to any disclaimer, the term of this patent is extended or adjusted under 35 U.S.C. 154(b) by 267 days.

(21) Appl. No.: 13/124,026

(22) PCT Filed: Oct. 13, 2009

(86) PCT No.: PCT/EP2009/063319
§ 371 (c)(1),
(2), (4) Date: Apr. 13, 2011

(87) PCT Pub. No.: WO2010/043603
PCT Pub. Date: Apr. 22, 2010

(65) Prior Publication Data

US 2011/0196064 A1 Aug. 11, 2011

(30) Foreign Application Priority Data

Oct. 13, 2008 (EP) ..... 08166427

(51) Int. Cl.
*C08K 3/18* (2006.01)
*C08G 18/69* (2006.01)

(52) U.S. Cl.
USPC ..... 524/430; 524/537; 524/605; 977/779

(58) Field of Classification Search
USPC ..... 523/200; 524/599, 605, 537, 539, 430, 524/432; 977/779
See application file for complete search history.

(56) References Cited

U.S. PATENT DOCUMENTS

| | | | | |
|---|---|---|---|---|
| 3,651,014 | A | 3/1972 | Witsiepe | |
| 4,148,846 | A | 4/1979 | Owens et al. | |
| 4,396,742 | A | 8/1983 | Binsack et al. | |
| 4,771,109 | A | 9/1988 | Eichenauer et al. | |
| 4,873,289 | A | 10/1989 | Lindner et al. | |
| 4,882,381 | A | 11/1989 | Wittmann et al. | |
| 5,010,135 | A | 4/1991 | Eckel et al. | |
| 5,496,887 | A | 3/1996 | Braune | |
| 6,646,100 | B2 | 11/2003 | Hofmann et al. | |
| 6,673,444 | B2 * | 1/2004 | Yuuki et al. | 428/364 |
| 7,081,509 | B2 | 7/2006 | Wagner et al. | |
| 7,317,065 | B2 | 1/2008 | Wagner et al. | |
| 8,093,195 | B2 * | 1/2012 | Uhl et al. | 510/221 |
| 2006/0058441 | A1 | 3/2006 | Delker et al. | |
| 2007/0173585 | A1 | 7/2007 | Sevenich et al. | |
| 2007/0207335 | A1 * | 9/2007 | Karandikar et al. | 428/560 |
| 2008/0154011 | A1 | 6/2008 | Wang et al. | |
| 2008/0214701 | A1 | 9/2008 | Wilms et al. | |

FOREIGN PATENT DOCUMENTS

| | | | |
|---|---|---|---|
| DE | 3725576 | A1 | 2/1989 |
| DE | 3800603 | A1 | 7/1989 |
| DE | 4401055 | A1 | 7/1995 |
| DE | 10138216 | A1 | 2/2003 |
| DE | 10147712 | A1 | 4/2003 |
| DE | 10163163 | A1 | 7/2003 |
| DE | 102005034980 | A1 | 1/2007 |
| EP | 50265 | A1 | 4/1982 |
| EP | 208187 | A2 | 1/1987 |
| EP | 235690 | A2 | 9/1987 |
| EP | 319290 | A2 | 6/1989 |
| EP | 1637633 | A1 | 3/2006 |

* cited by examiner

*Primary Examiner* — Hannah Pak
(74) *Attorney, Agent, or Firm* — Novak Druce Connolly Bove + Quigg LLP

(57) ABSTRACT

A process for producing at least one monofilament from a thermoplastic polymer material comprising at least one polyester and also nanoparticles and optionally further additives as components, comprises adding the components to an extruder as partial or complete mixtures or separately and the thermoplastic polymer material being initially strand extruded, cooled and stretched and finally heat-conditioned at a temperature in the range from 40 to 120° C. for 0.01 to 10 min. The invention further relates to using a monofilament obtained by the process in the manufacture of artificial turf, wigs and also as bristles for soft or stiff brushes.

12 Claims, No Drawings

METHOD FOR PRODUCING AN MONOFILAMENT AND USE OF THE MONOFILAMENT

CROSS-REFERENCE TO RELATED APPLICATIONS

This application is a national stage application (under 35 U.S.C. §371) of PCT/EP2009/063319, filed Oct. 13, 2009, which claims benefit of European application 08166427.8, filed Oct. 13, 2008.

BACKGROUND OF THE INVENTION

This invention relates to a process for producing at least one monofilament from a thermoplastic polymer material. The present invention further relates to a use for the monofilament.

Monofilaments are used for example for producing artificial turf. Further uses include for example artificial hair for wigs and also bristles for soft or stiff brushes.

Artificial turf is used for example in outdoor areas of hotel establishments or on sports fields. Depending on the kind of sport practiced on the sports fields it is particularly the bend recovery or else the sliding properties of the artificial turf fibers that are important. Artificial turf fibers currently utilize polyolefins which have good sliding properties but only poor bend recovery. Alternatively, it is known to use polyamides for making artificial turf which have good bend recovery. Polyamides are used for example for artificial turfs of field hockey pitches. Polyamides, however, have the disadvantage of poor sliding properties. To ensure acceptable coefficient of friction values, pitches or fields equipped with artificial turf composed of polyamide fibers have to be regularly watered.

To improve the properties of artificial turf surfaces, research is currently focusing particularly on different fiber geometries; the combination of different fibers in tufting; or the use of coextruded multipolymer fibers. However, these solutions only ever address partial aspects of the principal requirements, which are low friction, good bend recovery and low cost.

Artificial turf that utilizes polyolefins still does not have the ideal bend recovery despite optimized geometry for the synthetic turf monofils. By contrast, polyamides exhibit high coefficient of friction values which can cause player injury when the field, pitch or court has not been sufficiently and uniformly watered. Similarly, the use of different fibers for making artificial turf does not lead to the desired performance profile since bend recovery and friction characteristics are primarily dominated by the longer fiber.

The use of coextruded fibers for producing artificial turf is economically unattractive at present.

BRIEF SUMMERY OF THE INVENTION

It is an object of the present invention to provide a process for producing monofilaments having good bend recovery and good sliding properties, as desired in the manufacture of artificial turf for example.

We have found that this object is achieved by a process for producing at least one monofilament from a thermoplastic polymer material comprising at least one polyester and also nanoparticles and optionally further additives as components, which comprises adding the components to an extruder as mixtures or separately and the thermoplastic polymer material being initially strand extruded, cooled and stretched and finally heat-conditioned at a temperature in the range from 40 to 120° C. for 0.01 to 10 min.

One advantage of a monofilament produced according to the present invention is that it has improved bend recovery even compared with polyamide. In addition, the nanoparticles in the monofilament reduce the coefficient of friction value of the thermoplastic polymer material. The monofilaments obtained can thus be used particularly in applications requiring fibers having good bend recovery and a low coefficient of friction.

DETAILED DESCRIPTION OF THE INVENTION

The polymer material used for producing the monofilament comprises preferably 10% to 99.99% by weight of the polyester, more preferably 50% to 99.8% by weight and particularly 80% to 99.5% by weight. Also present are preferably 0.01% to 50% by weight of nanoparticles, more preferably 0.2% to 10% by weight and particularly 0.5% to 5% by weight of nanoparticles. The proportion of further additives is preferably in the range from 0% to 60% by weight, more preferably in the range from 1% to 40% by weight and particularly in the range from 2% to 20% by weight.

The polyester in the thermoplastic polymer material is preferably a polyester based on aromatic dicarboxylic acids and an aliphatic or aromatic dihydroxy compound.

Preferred polyesters are polyalkylene terephthalates, in particular polyalkylene terephthalates having 2 to 10 carbon atoms in the alcohol moiety.

Such polyalkylene terephthalates are known per se and are described in the literature. They comprise in the main chain an aromatic ring which comes from the aromatic dicarboxylic acid. The aromatic ring can also be substituted, for example by halogen such as chlorine and bromine or by $C_1$ to $C_4$-alkyl groups such as methyl, ethyl, i- or n-propyl or n-, i- or t-butyl groups.

These polyalkylene terephthalates are obtainable by reaction of aromatic dicarboxylic acids, their esters or other ester-forming derivatives with aliphatic dihydroxy compounds in a conventional manner.

Preferred dicarboxylic acids include 2,6-naphthalenedicarboxylic acid, terephthalic acid and isophthalic acid or mixtures thereof. Up to 30 mol % and preferably not more than 10 mol % of the aromatic dicarboxylic acids may be replaced by aliphatic or cycloaliphatic dicarboxylic acids such as adipic acid, azelaic acid, sebacic acid, dodecanedioic acids and cyclohexanedicarboxylic acids.

Of the aliphatic dihydroxy compounds, preference is given to diols having 2 to 6 carbon atoms, particularly 1,2-ethanediol, 1,3-propanediol, 1,4-butanediol, 1,6-hexanediol, 1,4-hexanediol, 1,4-cyclohexanediol, 1,4-cyclohexanedimethanol and neopentyl glycol or mixtures thereof.

Particularly preferred polyesters include polyalkylene terephthalates derived from alkanediols having 2 to 6 carbon atoms. Preference among these is given in particular to polyethylene terephthalate, polypropylene terephthalate and polybutylene terephthalate or mixtures thereof. Preference is further given to polyethylene terephthalate and/or polybutylene terephthalate which comprise up to 1% by weight, preferably up to 0.75% by weight, of 1,6-hexanediol and/or 2-methyl-1,5-pentanediol as further monomer units. Polybutylene terephthalate is very particularly preferred.

The viscosity number of the polyesters is generally in the range from 50 to 220, preferably from 80 to 160, measured in a 0.5% by weight solution in a phenol/o-dichlorobenzene mixture (weight ratio 1:1 at 25° C.) in accordance with ISO 1628. Preference is given in particular to polyesters whose carboxyl end group content is up to 100 meq/kg, preferably up to 50 meq/kg and particularly up to 40 meq/kg of polyester. Such polyesters are obtainable for example by following the method of DE-A 44 01 055. The carboxyl end group content is typically determined by titration methods, for example by potentiometry.

It is further advantageous to use PET recyclates, also termed scrap PET, if appropriate mixed with polyalkylene terephthalates such as polybutylene terephthalate.

Recyclates are generally:

1) those known as post-industrial recyclates: these are production wastes generated during polycondensation or during processing, for example sprues from injection molding, start-up material from injection molding or extrusion, or edge trims from extruded sheet or film,
2) post-consumer recyclates: these are plastics items which are collected and processed after use by the consumer. Blow-molded PET bottles for mineral water, soft drinks and juices are easily the predominant items in terms of quantity.

Both kinds of recyclate can be either in the form of regrind, or in the form of pellets. In the latter case, the crude recyclates are separated and cleaned and then melted and pelletized using an extruder. This usually facilitates handling and free flow and metering for further processing steps.

Not only recyclates in pelletized form but also recyclates in the form of regrind can be used, in which case the edge length should not be more than 10 mm, preferably less than 8 mm.

Because polyesters undergo hydrolytic cleavage during processing (due to traces of moisture), it is advisable to predry the recyclate. The residual moisture content after drying is preferably <0.2%, in particular <0.05%.

A further group to be mentioned is that of wholly aromatic polyesters, derived from aromatic dicarboxylic acids and aromatic dihydroxy compounds.

Suitable aromatic dicarboxylic acids are the compounds previously described for the polyalkylene terephthalates. Preference is given to using mixtures of 5 to 100 mol % of isophthalic acid and 0 to 95 mol % of terephthalic acid, in particular mixtures ranging from about 80% terephthalic acid with 20% isophthalic acid to substantially equivalent mixtures of these two acids.

The aromatic dihydroxy compounds preferably have the general formula

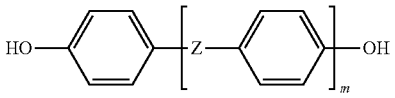

where Z is an alkylene or cycloalkylene group having up to 8 carbon atoms, an arylene group having up to 12 carbon atoms, a carbonyl group, a sulfonyl group, an oxygen or sulfur atom or a chemical bond and m is from 0 to 2. The phenylene groups of the compounds may also bear C1-C6-alkyl or alkoxy groups and fluorine, chlorine or bromine substituents.

As parent structures for these compounds that may be mentioned for example dihydroxybiphenyl,
di(hydroxyphenyl)alkane,
di(hydroxyphenyl)cycloalkane,
di(hydroxyphenyl)sulfide,
di(hydroxyphenyl)ether,
di(hydroxyphenyl)ketone,
di(hydroxyphenyl)sulfoxide,
α,α'-di(hydroxyphenyl)dialkylbenzene,
di(hydroxyphenyl)sulfone, di(hydroxybenzoyl)benzene
resorcinol and
hydroquinone and also ring-alkylated or ring-halogenated derivatives thereof.

Among these, preference is given to 4,4'-dihydroxybiphenyl,
2,4-d i(4'-hydroxyphenyl)-2-methylbutane
α,α'-di(4-hydroxyphenyl)-p-diisopropylbenzene,
2,2-di(3'-methyl-4'-hydroxyphenyl)propane and
2,2-di(3'-chloro-4'-hydroxyphenyl)propane, and also in particular to 2,2-di(4'-hydroxyphenyl)propane
2,2-di(3',5-dichlorodihydroxyphenyl)propane,
1,1-di(4'-hydroxyphenyl)cyclohexane,
3,4'-dihydroxybenzophenone,
4,4'-dihydroxydiphenyl sulfone and
2,2-di(3',5'-dimethyl-4'-hydroxyphenyl)propane or mixtures thereof.

It will be appreciated that it is also possible to use mixtures of polyalkylene terephthalates and wholly aromatic polyesters. These generally comprise 20% to 98% by weight of the polyalkylene terephthalate and 2% to 80% by weight of the wholly aromatic polyester.

It will be appreciated that it is also possible to use polyester block copolymers such as copolyetheresters. Products of this type are known per se and are described in the literature, for example in U.S. Pat. No. 3,651,014. Corresponding products are also available commercially, for example HytrelR (DuPont).

Polyesters for the purposes of the present invention also include halogen-free polycarbonates. Examples of suitable halogen-free polycarbonates are those based on diphenols of the general formula

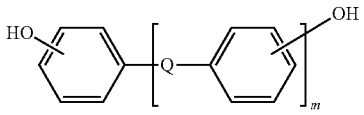

where Q is a single bond, a $C_1$ to $C_8$-alkylene, a $C_2$- to $C_3$-alkylidene, a $C_3$- to $C_6$-cycloalkylidene group, a $C_6$- to $C_{12}$-arylene group, or —O—, —S— or —$SO_2$—, and m is a whole number from 0 to 2.

The diphenols may also have substituents such as $C_1$- to $C_6$-alkyl or $C_1$- to $C_6$-alkoxy on the phenylene radicals.

Examples of preferred diphenols of the formula are hydroquinone, resorcinol, 4,4'-dihydroxybiphenyl, 2,2-bis(4-hydroxyphenyl)propane, 2,4-bis(4-hydroxyphenyl)-2-methylbutane, 1,1-bis(4-hydroxyphenyl)cyclohexane. Particular preference is given to 2,2-bis(4-hydroxyphenyl)propane and 1,1-bis(4-hydroxyphenyl)cyclohexane, and also to 1,1-bis(4-hydroxyphenyl)-3,3,5-trimethylcyclohexane.

Nanoparticles in the thermoplastic polymer material preferably utilize highly branched or hyperbranched polycarbonates having an OH number of 1 to 600 mg KOH/g polycarbonate (to DIN 53240 Part 2), highly branched or hyperbranched polyesters of the type $A_xB_y$ where x is at least 1.1 and y is at least 2.1, metal oxides, semimetal oxides and mixtures thereof. The nanoparticles may additionally comprise further additives.

For the purposes of this invention, highly branched or hyperbranched polycarbonates are uncrosslinked macromolecules having hydroxyl and carbonate groups and having both structural and molecular nonuniformity. They may firstly be constructed proceeding from a central molecule analogously to dendrimers, but with nonuniform chain lengths for the branches. They may also be constructed to have a linear structure with functional side groups, or alternatively they may combine the two extremes, having linear and branched moieties. See also P. J. Flory, J. Am. Chem. Soc. 1952, 74, 2718 and H. Frey et al., Chem. Eur. J. 2000, 6, No. 14, 2499 for definition of dendrimeric and hyperbranched polymers.

"Hyperbranched" in the context of the present invention is to be understood as meaning that the degree of branching (DB), i.e., the average number of dendritic linkages plus the average number of end groups per molecule, is from 10 to 99.9%, preferably 20 to 99%, more preferably 20 to 95%.

"Dendrimeric" in the context of the present invention is to be understood as meaning that the degree of branching is from 99.9 to 100%. See H. Frey et al., Acta Polym. 1997, 48, 30 for definition of "Degree of Branching".

The degree of branching (DB) of the entities in question is defined as $$DB = \frac{T+Z}{T+Z+L} \times 100\%,$$

where T is the average number of terminal monomer units, Z is the average number of branched monomer units, and L is the average number of linear monomer units in the macromolecules of the respective entities.

The number average molecular weight $M_n$ of the highly branched or hyperbranched polycarbonate is preferably in the range from 100 to 15 000, preferably in the range from 200 to 12 000 and particularly in the range from 500 to 10 000 g/mol (GPC, PMMA standard).

The glass transition temperature Tg is in particular from −80° C. to +140° C., preferably from −60 to 120° C. (as per DSC, DIN 53765).

Viscosity (mPas) at 23° C. (in accordance with DIN 53019) is in particular in the range from 50 to 200 000, in particular in the range from 100 to 150 000 and very particularly preferably in the range from 200 to 100 000.

The highly branched or hyperbranched polycarbonate is preferably obtainable by a process comprising at least the following steps:

a) reaction of at least one organic carbonate (A) of the general formula $RO[(RCO)]_nOR$ with at least one aliphatic, aliphatic-aromatic or aromatic alcohol (B) which includes at least 3 OH groups by elimination of alcohols ROH to form one or more condensation products (K), where each R is independently of the others a straight-chain or branched aliphatic, aromatic-aliphatic or aromatic hydrocarbyl radical having 1 to 20 carbon atoms, and where the R radicals may also be bonded to each other to form a ring, and n is a whole number between 1 and 5, or ab) reaction of phosgene, diphosgene or triphosgene with the above alcohol (B) by elimination of hydrogen chloride, and b) intermolecular reaction of the condensation products (K) to form a highly branched or hyperbranched high-functionality polycarbonate, wherein the quantitative ratio of the OH groups to the carbonates in the reaction mixture is so chosen that the condensation products (K) on average have either one carbonate group and more than one OH group or one OH group and more than one carbonate group.

Phosgene, diphosgene or triphosgene can be used as starting material, although organic carbonates are preferred.

Each of the R radicals in the starting organic carbonates (A) of the general formula RO(CO)OR independently represents a straight-chain or branched aliphatic, aromatic-aliphatic or aromatic hydrocarbyl radical having 1 to 20 carbon atoms. The two R radicals may also be bonded together to form a ring. An aliphatic hydrocarbyl radical is preferred and a straight-chain or branched alkyl radical having 1 to 5 carbon atoms or a substituted or unsubstituted phenyl radical is particularly preferred.

Simple carbonates of the formula $RO(CO)_nOR$ are used in particular; n is preferably from 1 to 3, in particular 1.

Dialkyl or diaryl carbonates are obtainable for example from the reaction of aliphatic, araliphatic or aromatic alcohols, preferably monoalcohols, with phosgene. They are further obtainable via oxidative carbonylation of alcohols or phenols with CO in the presence of noble metals, oxygen or $NO_x$. For methods to prepare diaryl or dialkyl carbonates see also Ullmann's Encyclopedia of Industrial Chemistry, 6th Edition, 2000 Electronic Release, Verlag Wiley-VCH.

Examples of suitable carbonates comprise aliphatic, aromatic/aliphatic or aromatic carbonates such as ethylene carbonate, 1,2-propylene carbonate, 1,3-propylene carbonate, diphenyl carbonate, ditolyl carbonate, dixylyl carbonate, dinaphthyl carbonate, ethyl phenyl carbonate, dibenzyl carbonate, dimethyl carbonate, diethyl carbonate, dipropyl carbonate, dibutyl carbonate, diisobutyl carbonate, dipentyl carbonate, dihexyl carbonate, dicyclohexyl carbonate, diheptyl carbonate, dioctyl carbonate, didecyl carbonate or didodecyl carbonate.

Examples of carbonates where n is greater than 1 comprise dialkyl dicarbonates, such as di(t-butyl)dicarbonate or dialkyl tricarbonates such as di(t-butyl)tricarbonate.

Preference is given to using aliphatic carbonates, in particular those where the radicals comprise 1 to 5 carbon atoms, examples being dimethyl carbonate, diethyl carbonate, dipropyl carbonate, dibutyl carbonate or diisobutyl carbonate.

The organic carbonates are reacted with at least one aliphatic alcohol (B) which has at least 3 OH groups, or with mixtures of two or more different alcohols.

Examples of compounds having at least three OH groups comprise glycerol, trimethylolmethane, trimethylolethane, trimethylolpropane, 1,2,4-butanetriol, tris(hydroxymethyl)amine, tris(hydroxyethyl)amine, tris(hydroxypropyl)amine, pentaerythritol, diglycerol, triglycerol, polyglycerols, tris(hydroxymethyl)isocyanurate, tris(hydroxyethyl)isocyanurate, phloroglucinol, trihydroxytoluene, trihydroxydimethylbenzene, phloroglucides, hexahydroxybenzene, 1,3,5-benzene-trimethanol, 1,1,1-tris(4'-hydroxyphenyl)methane, 1,1,1-tris(4'-hydroxyphenyl)ethane, bis(trimethylolpropane) or sugars, for example glucose, tri- or more highly hydric polyetherols based on tri- or more highly hydric alcohols and ethylene oxide, propylene oxide or butylene oxide, or polyesterols. Of these, glycerol, trimethylolethane, trimethylolpropane, 1,2,4-butanetriol, pentaerythritol and also their polyetherols based on ethylene oxide or propylene oxide are particularly preferred.

These polyhydric alcohols can also be used in admixture with difunctional alcohols (B') provided that the average total OH functionality over all the alcohols used is greater than 2. Examples of suitable compounds having two OH groups comprise ethylene glycol, diethylene glycol, triethylene glycol, 1,2-propanediol, 1,3-propanediol, dipropylene glycol, tripropylene glycol, neopentyl glycol, 1,2-butanediol, 1,3-butanediol, 1,4-butanediol, 1,2-pentanediol, 1,3-pentanediol, 1,5-pentanediol, hexanediol, cyclopentanediol, cyclohexanediol, cyclohexanedimethanol, bis(4-hydroxycyclohexyl)-methane, bis(4-hydroxycyclohexyl)ethane, 2,2-bis(4-hydroxycyclohexyl)propane, 1,1'-bis(4-hydroxyphenyl)-3,3-5-trimethylcyclohexane, resorcinol, hydroquinone, 4,4'-dihydroxybiphenyl, bis(4-bis(hydroxyphenyl)sulfide, bis(4-hydroxyphenyl)sulfone, bis(hydroxymethyl)benzene, bis(hydroxymethyl)toluene, bis(p-hydroxyphenyl)methane, bis(p-hydroxyphenyl)ethane, 2,2-bis(p-hydroxyphenyl)propane, 1,1-bis(p-hydroxy-phenyl)cyclohexane, dihydroxybenzophenone, dihydric polyether polyols based on ethylene oxide, propylene oxide, butylene oxide or mixtures thereof, polytetrahydrofuran, polycaprolactone or polyesterols based on diols and dicarboxylic acids.

The diols serve to fine-tune the properties of the polycarbonate. When dihydric alcohols are used, the ratio of dihydric alcohols (B') to the at least trihydric alcohols (B) is ascertained by a person skilled in the art according to the properties desired for the polycarbonate. In the general case, the amount of the alcohol or alcohols (B') is in the range from 0 to 39.9 mol % relative to the total amount of all alcohols (B) and (B') together. The amount is preferably in the range from 0 to 35 mol %, more preferably in the range from 0 to 25 mol % and most preferably in the range from 0 to 10 mol %.

The reaction of phosgene, diphosgene or triphosgene with the alcohol or alcohol mixture generally takes place with elimination of hydrogen chloride, and the reaction of the carbonates with the alcohol or alcohol mixture to form the highly branched high-functionality polycarbonate of the present invention takes place with elimination of the monohydric alcohol or phenol from the carbonate molecule.

The highly branched high-functionality polycarbonates formed by following the process of the present invention have in the as-reacted state, i.e., without further modification, terminal hydroxyl groups and/or terminal carbonate groups. They have good solubility in various solvents, for example in water, alcohols, such as methanol, ethanol, butanol, alcohol-water mixtures, acetone, 2-butanone, ethyl acetate, butyl acetate, methoxypropyl acetate, methoxyethyl acetate, tetrahydrofuran, dimethylformamide, dimethylacetamide, N-methylpyrrolidone, ethylene carbonate or propylene carbonate.

For the purposes of this invention, a high-functionality polycarbonate is a product which, besides the carbonate groups which form the polymeric scaffold, further includes at least three, preferably at least six, more preferably at least ten, functional groups in the terminal or pendent position. The functional groups comprise carbonate groups and/or OH groups. There is in principle no upper limit to the number of terminal or pendent functional groups, but products having a very high number of functional groups can have undesired properties, such as high viscosity or poor solubility for example. The high-functionality polycarbonates of the present invention mostly include not more than 500 terminal or pendent functional groups, preferably not more than 100 terminal or pendent functional groups.

To prepare the high-functionality polycarbonates, the ratio of the OH-containing compounds to phosgene or carbonate has to be such that the simplest resultant condensation product (hereinafter called condensation product (K)) comprises on average either one carbonate group or carbamoyl group and more than one OH group, or one OH group and more than one carbonate group or carbamoyl group. The simplest structure for the condensation product (K) formed from a carbonate (A) and a di- or polyalcohol (B) results in the arrangement $XY_n$ or $Y_nX$, where X is a carbonate group, Y is a hydroxyl group and n is generally a number between 1 and 6, preferably between 1 and 4, more preferably between 1 and 3. The reactive group which is the single resultant group will generally be referred to as "focal group" hereinbelow.

When, for example, the reaction ratio is 1:1 for the preparation of the simplest condensation product (K) from a carbonate and a dihydric alcohol, the average result is a molecule of the XY type, illustrated by the general formula (1).

(1)

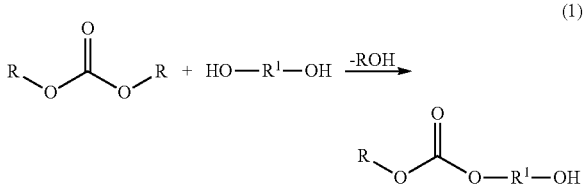

The preparation of the condensation product (K) from a carbonate and a trihydric alcohol at a reaction ratio of 1:1 results on average in a molecule of the $XY_2$ type, illustrated by the general formula (2). A carbonate group is focal group here.

(2)

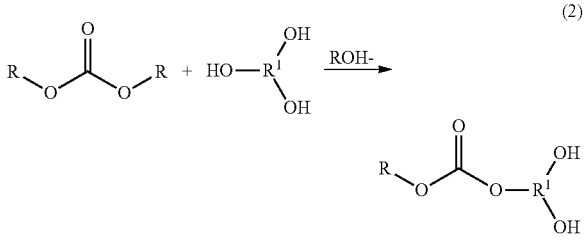

The preparation of the condensation product (K) from a carbonate and a tetrahydric alcohol, likewise at a reaction ratio of 1:1, results on average in a molecule of the $XY_3$ type, illustrated by the general formula (3). A carbonate group is focal group here.

(3)

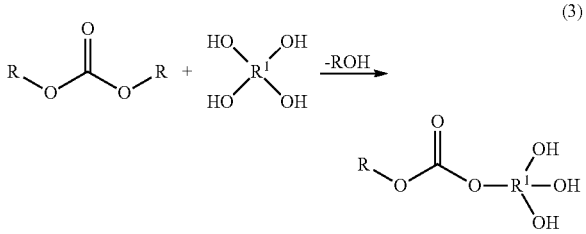

In the formulae 1 to 3, R is as defined at the outset and $R^1$ is an aliphatic or aromatic radical.

The condensation product (K) may further be prepared for example from a carbonate and a trihydric alcohol, illustrated by the general formula (4), at a reaction ratio of 2:1 molar. The average result here is a molecule of the $X_2Y$ type, an OH group being focal group. In the formula (4), R and $R^1$ each have the same meanings as in the formulae (1) to (3).

(4)

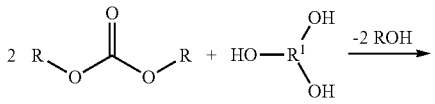

-continued

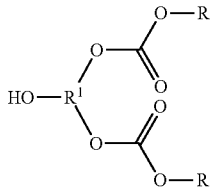

When difunctional compounds, for example a dicarbonate or a diol, are also added to the components, this results in an extension of the chains, as illustrated in the general formula (5) for example. The result is again on average a molecule of the $XY_2$ type, a carbonate group being focal group.

(5)

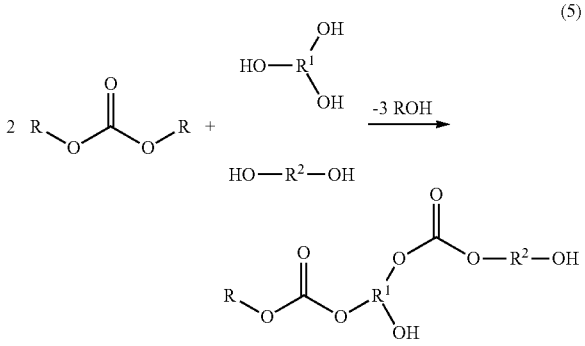

In the formula (5), $R^2$ is an organic radical, preferably an aliphatic radical, and R and $R^1$ are each as defined above.

It is also possible to use two or more condensation products (K) for synthesis. In this case, two or more alcohols and/or two or more carbonates can be used. Furthermore, mixtures of various condensates of different structures are obtainable by varying the ratio of the alcohols used and of the carbonates, or of the phosgenes. This may be elucidated by way of example using the reaction of a carbonate with a trihydric alcohol. When the starting materials are used in a ratio of 1:1, as shown in formula (2), the result is an $XY_2$ molecule. When the starting materials are used in a ratio of 2:1, as shown in formula (4), the result is an $X_2Y$ molecule. When the ratio is between 1:1 and 2:1, a mixture of $XY_2$ and $X_2Y$ molecules is obtained.

According to the present invention, the simple condensation products (K) described by way of example in the formulae (1) to (5) preferentially react intermolecularly to form high-functionality polycondensation products, hereinafter called polycondensation products (P). The reaction to form the condensation product (K) and to form the polycondensation product (P) typically takes place at a temperature of 0 to 250° C., preferably at 60 to 160° C., with or without a solvent. If a solvent is used, it is generally possible to use any solvent that is inert with regard to the respective reactants. Preference is given to using organic solvents, examples being decane, dodecane, benzene, toluene, chlorobenzene, xylene, dimethylformamide, dimethylacetamide or solvent naphtha.

In one preferred embodiment, the condensation reaction is carried out without solvent. To speed the reaction, the phenol or the monohydric alcohol ROH released during the reaction can be removed from the reaction equilibrium by distillation, if appropriate at reduced pressure.

When removal by distillation is intended, it is generally advisable to use such carbonates as release alcohols ROH during the reaction that have a boiling point below 140° C.

The reaction may also be speeded by adding catalysts or catalyst mixtures. Suitable catalysts are compounds that catalyze esterification or transesterification reactions, examples being alkali metal hydroxides, alkali metal carbonates, alkali metal bicarbonates, preferably of sodium, of potassium or of cesium, tertiary amines, guanidines, ammonium compounds, phosphonium compounds, organoaluminum, organotin, organozinc, organotitanium, organozirconium or organobismuth compounds, or else so-called double metal cyanide (DMC) catalysts as described for example in DE 10138216 or DE 10147712.

It is preferable to use potassium hydroxide, potassium carbonate, potassium bicarbonate, diazabicyclooctane (DABCO), diazabicyclononene (DBN), diazabicycloundecene (DBU), imidazoles, such as imidazole, 1-methylimidazole or 1,2-dimethylimidazole, titanium tetrabutoxide, titanium tetraisopropoxide, dibutyltin oxide, dibutyltin dilaurate, tin dioctoate, zirconium acetylacetonate, or mixtures thereof.

The amount of catalyst added is generally in the range from 50 to 10 000 weight ppm, and preferably in the range from 100 to 5000 weight ppm, based on the amount of alcohol or alcohol mixture used.

It is also possible to control the intermolecular polycondensation reaction through addition of the suitable catalyst or else through selection of a suitable temperature. It is further possible to fine-tune the average molecular weight for polymer (P) via the composition of the starting components and via the residence time.

The condensation products (K) and the polycondensation products (P) prepared at elevated temperature are usually stable at room temperature for a prolonged period.

It is the constitution of the condensation products (K) which makes it possible for the condensation reaction to give rise to polycondensation products (P) having different structures with branching but no crosslinking. Furthermore, in the ideal case, the polycondensation products (P) have either one carbonate group as focal group and more than two OH groups, or else one OH group as focal group and more than two carbonate groups. The number of reactive groups results from the constitution of the condensation products (K) used and from the degree of polycondensation.

For example, a condensation product (K) of the general formula (2) can react via triple intermolecular condensation to form two different polycondensation products (P), represented in the general formulae (6) and (7)

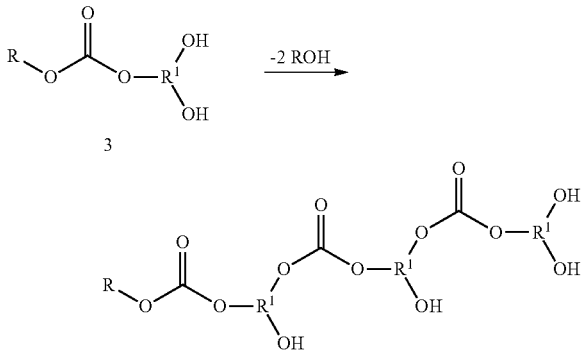

3

(6)

-continued

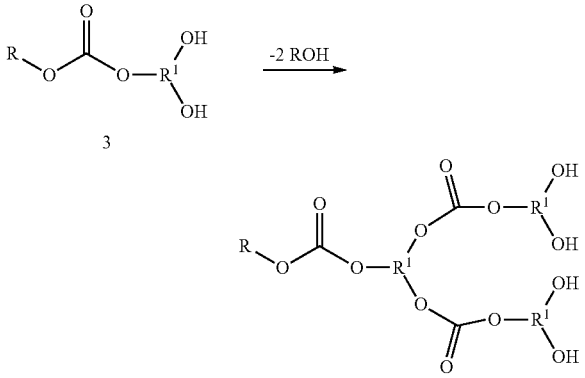

where R and $R^1$ are each as defined above.

There are various ways of terminating the intermolecular polycondensation reaction.

For example, the temperature can be lowered to a range where the reaction stops and product (K) or the polycondensation product (P) is storage stable.

It is further possible to deactivate the catalyst, for example by addition of Lewis acids or protic acids in the case of basic catalysts.

In another embodiment, as soon as the intermolecular reaction of the condensation product (K) has produced a polycondensation product (P) having the desired degree of polycondensation, the product (P) may have a material having groups reactive toward the focal group of (P) added to it to terminate the reaction. For instance, a mono-, di- or polyamine can be added in the case of a carbonate group as focal group. In the case of a hydroxyl group as focal group, the product (P) may have added to it, for example, a mono-, di- or polyisocyanate, an epoxy-containing compound or an OH-reactive acid derivative.

The high-functionality polycarbonates of the present invention are usually prepared in the pressure range from 0.1 mbar to 20 bar, preferably at 1 mbar to 5 bar, in reactors or reactor cascades which are operated batchwise, semicontinuously or continuously.

The as-prepared products of the present invention can be further processed without further purification owing to the aforementioned settings for the reaction conditions and, if appropriate, owing to the choice of suitable solvent.

In another preferred embodiment, the product is stripped, i.e., freed of low molecular weight, volatile compounds. For this, once the desired degree of conversion has been reached, the catalyst may optionally be deactivated and the low molecular weight volatile constituents, for example monoalcohols, phenols, carbonates, hydrogen chloride or volatile oligomeric or cyclic compounds, can be removed by distillation, if appropriate by introduction of a gas, preferably nitrogen, carbon dioxide or air, if appropriate at reduced pressure.

In a further preferred embodiment, the polycarbonates of the present invention may, in addition to the functional groups already acquired through the reaction, acquire further functional groups. The functionalization may take place during the molecular weight increase or else subsequently, i.e., after the actual polycondensation has ended.

When components which, besides hydroxyl or carbonate groups, possess further functional groups or functional elements are added before or during the molecular weight increase, a polycarbonate polymer is obtained that includes randomly distributed functionalities other than the carbonate or hydroxyl groups.

Effects of this kind are obtainable for example through addition of compounds during the polycondensation which, as well as hydroxyl groups, carbonate groups or carbamoyl groups, bear further functional groups or functional elements, such as mercapto groups, primary, secondary or tertiary amino groups, ether groups, derivatives of carboxylic acids, derivatives of sulfonic acids, derivatives of phosphonic acids, silane groups, siloxane groups, aryl radicals or long-chain alkyl radicals. Examples of compounds which may be used for modification by means of carbamate groups are ethanolamine, propanolamine, isopropanolamine, 2-(butylamino) ethanol, 2-(cyclohexylamino)ethanol, 2-amino-1-butanol, 2-(2"-aminoethoxy)ethanol or higher alkoxylation products of ammonia, 4-hydroxypiperidine, 1-hydroxyethylpiperazine, diethanolamine, dipropanolamine, diisopropanolamine, tris(hydroxymethyl)-aminomethane, tris(hydroxyethyl)aminomethane, ethylenediamine, propylenediamine, hexamethylenediamine or isophoronediamine.

Modification with mercapto groups is obtainable by using mercaptoethanol for example. Tertiary amino groups can be produced for example through incorporation of N-methyldiethanolamine, N-methyldipropanolamine or N,N-dimethylethanolamine. Ether groups may be generated for example by cocondensation of di- or more highly hydric polyetherols. Long-chain alkyl radicals can be introduced by reaction with long-chain alkanediols, and the reaction with alkyl or aryl diisocyanates generates polycarbonates having alkyl, aryl and urethane groups or urea groups.

Ester groups can be produced by addition of dicarboxylic acids, tricarboxylic acids, for example dimethyl terephthalate, or tricarboxylic esters.

Subsequent functionalization is obtainable by using an additional process step (step c)) to react the resultant highly branched or hyperbranched high-functionality polycarbonate with a suitable functionalizing reagent capable of reacting with the OH and/or carbonate groups or carbamoyl groups of the polycarbonate.

Hydroxyl-containing highly branched or hyperbranched high-functionality polycarbonates are modifiable for example by addition of molecules comprising acid groups or isocyanate groups. For example, polycarbonates comprising acid groups are obtainable by reaction with compounds comprising anhydride groups.

Hydroxyl-containing high-functionality polycarbonates can also be converted into high-functionality polycarbonate polyetherpolyols by reaction with alkylene oxides, for example ethylene oxide, propylene oxide or butylene oxide.

One great advantage of the process resides in its economy. Both the conversion to a condensation product (K) or polycondensation product (P) and the reaction of (K) or (P) to form polycarbonates having other functional groups or elements can take place in one reaction apparatus, and this is technically and commercially advantageous.

The highly branched or hyperbranched polyesters in the molding materials of the present invention may comprise at least one hyperbranched polyester of the $A_xB_y$ type, where x is at least 1.1, preferably at least 1.3, in particular at least 2 y is at least 2.1, preferably at least 2.5, in particular at least 3.

It will be appreciated that mixtures can also be used as units A and/or B.

An $A_xB_y$ type polyester is a condensate constructed of an x-functional molecule A and a y-functional molecule B. An example is a polyester formed from adipic acid as molecule A (x=2) and glycerol as molecule B (y=3).

For the purposes of this invention, highly branched or hyperbranched polyesters are uncrosslinked macromolecules having hydroxyl and carboxyl groups and having both structural and molecular nonuniformity. They may firstly be constructed proceeding from a central molecule analogously to dendrimers, but with nonuniform chain lengths for the branches. They may also be constructed to have a linear structure with functional side groups, or alternatively they may combine the two extremes, having linear and branched moieties. See also P. J. Flory, J. Am. Chem. Soc. 1952, 74, 2718 and H. Frey et al., Chem. Eur. J. 2000, 6, No. 14, 2499 for definition of dendrimeric and hyperbranched polymers.

"Hyperbranched" in the context of the present invention is to be understood as meaning that the degree of branching (DB), i.e., the average number of dendritic linkages plus the average number of end groups per molecule, is from 10 to 99.9%, preferably 20 to 99%, more preferably 20 to 95%.

"Dendrimeric" in the context of the present invention is to be understood as meaning that the degree of branching is from 99.9 to 100%. See H. Frey et al., Acta Polym. 1997, 48, 30 for definition of "Degree of Branching" and formula recited above in relation to highly branched or hyperbranched polycarbonates.

The highly branched or hyperbranched polyester preferably has an $M_n$ of 300 to 30 000, in particular of 400 to 25 000 and very particularly from 500 to 20 000 g/mol, determined by GPC, PMMA standard, dimethylacetamide eluent.

The highly branched or hyperbranched polyester preferably has an OH number of 0 to 600, preferably 1 to 500, and in particular 20 to 500 mg KOH/g of polyester, measured in accordance with DIN 53240, and also preferably a COOH number of 0 to 600, preferably 1 to 500 and particularly of 2 to 500 mg KOH/g of polyester.

The $T_g$ is preferably in the range from −50° C. to 140° C. and particularly in the range from −50 to 100° C. (by DSC, to DIN 53765).

Preference is given particularly to those highly branched or hyperbranched polyesters in which at least one OH number or, respectively, COOH number is greater than 0, preferably greater than 0.1 and, in particular, greater than 0.5.

The highly branched or hyperbranched polyester of the present invention is obtainable in particular by the hereinbelow described process, viz., by reacting (a) one or more dicarboxylic acids or one or more derivatives thereof with one or more at least trihydric alcohols or (b) one or more tricarboxylic acids or higher polycarboxylic acids or one or more derivatives thereof with one or more diols in the presence of a solvent and optionally in the presence of an inorganic, organometallic or low molecular weight organic catalyst, or of an enzyme. The reaction in solvent is the preferred method of preparation.

For the purposes of the present invention, hyperbranched high-functionality polyesters have molecular and structural nonuniformity. Their molecular nonuniformity distinguishes them from dendrimers, and they are therefore obtainable at appreciably lower cost and inconvenience.

The dicarboxylic acids which can be reacted according to variant (a) include for example oxalic acid, malonic acid, succinic acid, glutaric acid, adipic acid, pimelic acid, suberic acid, azelaic acid, sebacic acid, undecane-α,ω-dicarboxylic acid, dodecane-α,ω-dicarboxylic acid, cis- and trans-cyclohexane-1,2-dicarboxylic acid, cis- and trans-cyclohexane-1,3-dicarboxylic acid, cis- and trans-cyclohexane-1,4-dicarboxylic acid, cis- and trans-cyclopentane-1,2-dicarboxylic acid and also cis- and trans-cyclopentane-1,3-dicarboxylic acid, where the abovementioned dicarboxylic acids can be substituted with one or more radicals selected from $C_1$-$C_{10}$-alkyl groups, for example methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, isoheptyl, n-octyl, 2-ethylhexyl, n-nonyl or n-decyl, $C_3$-$C_{12}$-cycloalkyl groups, for example cyclopropyl, cyclobutyl, cyclopentyl, cyclohexyl, cycloheptyl, cyclooctyl, cyclononyl, cyclodecyl, cycloundecyl and cyclododecyl; preference is given to cyclopentyl, cyclohexyl and cycloheptyl;

alkylene groups such as methylene or ethylidene or $C_6$-$C_{14}$-aryl groups such as for example phenyl, 1-naphthyl, 2-naphthyl, 1-anthryl, 2-anthryl, 9-anthryl, 1-phenanthryl, 2-phenanthryl, 3-phenanthryl, 4-phenanthryl and 9-phenanthryl, preferably phenyl, 1-naphthyl and 2-naphthyl, more preferably phenyl.

Illustrative representatives of substituted dicarboxylic acids are: 2-methylmalonic acid, 2-ethylmalonic acid, 2-phenylmalonic acid, 2-methylsuccinic acid, 2-ethylsuccinic acid, 2-phenylsuccinic acid, itaconic acid, 3,3-dimethylglutaric acid.

The dicarboxylic acids reactable according to variant (a) further include ethylenically unsaturated acids such as for example maleic acid and fumaric acid and also aromatic dicarboxylic acids such as for example phthalic acid, isophthalic acid or terephthalic acid.

It is also possible to use mixtures of two or more of the aforementioned representatives.

The dicarboxylic acids can either be used as such or in the form of derivatives.

Derivatives are preferably the corresponding anhydrides in monomeric or else polymeric form, mono- or dialkyl esters, preferably mono- or dimethyl esters or the corresponding mono- or diethyl esters, but also the mono- and dialkyl esters derived from higher alcohols such as for example n-propanol, isopropanol, n-butanol, isobutanol, tert-butanol, n-pentanol, n-hexanol, also mono- and divinyl esters, and also mixed esters, preferably methyl ethyl esters.

The preferred process may also utilize a mixture of a dicarboxylic acid and one or more of its derivatives. It is similarly possible to use a mixture of two or more different derivatives of one or more dicarboxylic acids.

Particular preference is given to using succinic acid, glutaric acid, adipic acid, phthalic acid, isophthalic acid, terephthalic acid or their mono- or dimethyl esters. It is very particularly preferable to use adipic acid.

Useful at least trihydric alcohols include for example: glycerol, butane-1,2,4-triol, n-pentane-1,2,5-triol, n-pentane-1,3,5-triol, n-hexane-1,2,6-triol, n-hexane-1,2,5-triol, n-hexane-1,3,6-triol, trimethylolbutane, trimethylolpropane or ditrimethylolpropane, trimethylolethane, pentaerythritol or dipentaerythritol; sugar alcohols such as for example mesoerythritol, threitolol, sorbitol, mannitol or mixtures thereof. Preference is given to using glycerol, trimethylolpropane, trimethylolethane and pentaerythritol.

Tricarboxylic acids or polycarboxylic acids reactable according to variant (b) include for example 1,2,4-benzenetricarboxylic acid, 1,3,5-benzenetricarboxylic acid, 1,2,4,5-benzenetetracarboxylic acid and also mellitic acid.

Tricarboxylic acids or polycarboxylic acids can be used in the reaction of the present invention either as such or else in the form of derivatives.

Derivatives are preferably the corresponding anhydrides in monomeric or else polymeric form, mono-, di- or trialkyl esters, preferably mono-, di- or trimethyl esters or the corresponding mono-, di- or triethyl esters, but also the mono-, di- or triesters derived from higher alcohols such as for example n-propanol, isopropanol, n-butanol, isobutanol, tert-butanol, n-pentanol, n-hexanol, also mono- di- or trivinyl esters, and also mixed methyl ethyl esters.

For the purposes of the present invention, it is also possible to use a mixture of a tri- or polycarboxylic acid and one or more of its derivatives. For the purposes of the present invention it is similarly possible to use a mixture of two or more different derivatives of one or more tri- or polycarboxylic acids to obtain highly branched or hyperbranched polyesters.

Useful diols for variant (b) of the present invention include for example ethylene glycol, propane-1,2-diol, propane-1,3-diol, butane-1,2-diol, butane-1,3-diol, butane-1,4-diol, butane-2,3-diol, pentane-1,2-diol, pentane-1,3-diol, pentane-1,4-diol, pentane-1,5-diol, pentane-2,3-diol, pentane-2,4-diol, hexane-1,2-diol, hexane-1,3-diol, hexane-1,4-diol, hexane-1,5-diol, hexane-1,6-diol, hexane-2,5-diol, heptane-1,2-diol 1,7-heptanediol, 1,8-octanediol, 1,2-octanediol, 1,9-nonanediol, 1,10-decanediol, 1,2-decanediol, 1,12-dodecanediol, 1,2-dodecanediol, 1,5-hexadiene-3,4-diol, cyclopentanediols, cyclohexanediols, inositol and derivatives, (2)-methyl-2,4-pentanediol, 2,4-dimethyl-2,4-pentanediol, 2-ethyl-1,3-hexanediol, 2,5-dimethyl-2,5-hexanediol, 2,2,4-trimethyl-1,3-pentanediol, pinacol, diethylene glycol, triethylene glycol, dipropylene glycol, tripropylene glycol, polyethylene glycols $HO(CH_2CH_2O)_n$—H or polypropylene glycols $HO(CH[CH_3]CH_2O)_n$—H or mixtures of two or more representatives of the above compounds where n is a whole number and n>=4. One, or else both, of the hydroxyl groups in the aforementioned diols can also be replaced by SH groups. Preference is given to ethylene glycol, propane-1,2-diol and also diethylene glycol, triethylene glycol, dipropylene glycol and tripropylene glycol.

The molar ratio of the molecules A to molecules B in the $A_xB_y$ polyester in the variants (a) and (b) is in the range from 4:1 to 1:4, particularly in the range from 2:1 to 1:2.

The at least trihydric alcohols reacted according to variant (a) of the process may have hydroxyl groups which all have the same reactivity. Preference is also given here to at least trihydric alcohols whose OH groups initially have the same reactivity, but where reaction with at least one acid group induces a fall-off in reactivity for the remaining OH groups due to steric or electronic effects. This is the case for example with the use of trimethylolpropane or pentaerythritol.

However, the at least trihydric alcohols reacted according to variant (a) may also have hydroxyl groups having at least two chemically different reactivities.

The difference in reactivity of the functional groups may derive either from chemical causes (for example primary/secondary/tertiary OH group) or from steric causes.

For instance, the triol may comprise a triol which has primary and secondary hydroxyl groups, a preferred example being glycerol.

When the reaction of the present invention is carried out according to variant (a), it is preferable to operate in the absence of diols and of monohydric alcohols.

When the reaction of the present invention is carried out according to variant (b), it is preferable to operate in the absence of mono- or dicarboxylic acids.

The process of the present invention is carried out in the presence of a solvent. Useful solvents include for example hydrocarbons such as paraffins or aromatics. Particularly suitable paraffins are n-heptane and cyclohexane. Particularly suitable aromatics are toluene, ortho-xylene, meta-xylene, para-xylene, xylene in the form of an isomeric mixture, ethylbenzene, chlorobenzene and ortho- and meta-dichlorobenzene. Very particularly suitable solvents for the use in the absence of acidic catalysts are: ethers such as for example dioxane or tetrahydrofuran and ketones such as for example methyl ethyl ketone and methyl isobutyl ketone.

According to the present invention, the amount of solvent added is at least 0.1% by weight, based on the mass of the starting materials used and to be reacted, preferably at least 1% by weight and more preferably at least 10% by weight. It is also possible to use excesses of solvent, based on the weight of starting materials used and to be reacted, for example from 1.01 to 10 times the amount. Solvent amounts of more than 100 times the mass of the starting materials used and to be reacted are not advantageous since the reaction rate decreases distinctly at distinctly lower concentrations for the reactants, giving uneconomically long reaction times.

The process preferred according to the present invention may be carried out by conducting the reaction in the presence of a water-withdrawing additive, added at the start of the reaction. Suitable examples are molecular sieves, in particular 4 Å molecular sieve, $MgSO_4$ and $Na_2SO_4$. During the reaction, further water-withdrawing additive can be added or water-withdrawing additive can be replaced by fresh water-withdrawing additive. It is also possible during the reaction to remove the water or alcohol formed, by distillation, and to use a water trap for example.

The process can be carried out in the absence of acidic catalysts. It is preferable to carry it out in the presence of an acidic inorganic, organometallic or organic catalyst or of a mixture of two or more acidic inorganic, organometallic or organic catalysts.

Useful acidic inorganic catalysts for the purposes of the present invention include for example sulfuric acid, phosphoric acid, phosphonic acid, hypophosphorous acid, aluminum sulfate hydrate, alum, acidic silica gel (pH=6, in particular=5) and acidic alumina. It is further possible to use for example aluminum compounds of the general formula $Al(OR)_3$ and titanates of the general formula $Ti(OR)_4$ as acidic inorganic catalysts, in which case each of the R radicals may be the same or different and is selected independently of the others from $C_1$-$C_{10}$-alkyl radicals, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, isoheptyl, n-octyl, 2-ethylhexyl, n-nonyl or n-decyl, $C_3$-$C_{12}$-cycloalkyl radicals, for example cyclopropyl, cyclobutyl, cyclopentyl, cyclohexyl, cycloheptyl, cyclooctyl, cyclononyl, cyclodecyl, cycloundecyl and cyclododecyl; preference is given to cyclopentyl, cyclohexyl and cycloheptyl.

Each of the R radicals in $Al(OR)_3$ or $Ti(OR)_4$ is preferably the same and selected from isopropyl or 2-ethylhexyl.

Preferred acidic organometallic catalysts are selected for example from dialkyltin oxides $R_2SnO$, where R is as defined above. A particularly preferred representative of acidic organometallic catalysts is di-n-butyltin oxide, which is commercially available as "oxo-tin", or di-n-butyltin dilaurate.

Preferred acidic organic catalysts are acidic organic compounds having for example phosphate groups, sulfonic acid groups, sulfate groups or phosphonic acid groups. Particular preference is given to sulfonic acids such as for example para-toluenesulfonic acid. Acidic ion exchangers may also be used as acidic organic catalysts, examples being polystyrene resins comprising sulfonic acid groups and crosslinked with about 2 mol % of divinylbenzene. It is also possible to use combinations of two or more of the aforementioned catalysts. It is similarly possible to use an immobilized form of organic or organometallic or else inorganic catalysts which take the form of discrete molecules.

When acidic inorganic, organometallic or organic catalysts are to be used, the amount used according to the present invention is from 0.1% to 10% by weight and preferably from 0.2% to 2% by weight of catalyst.

The process of the present invention is carried out under inert gas, i.e., for example under carbon dioxide, nitrogen or noble gas, of which argon is suitable in particular.

The process of the present invention is carried out at temperatures of 60 to 200° C. It is preferable to employ temperatures of 130 to 180° C., in particular up to 150° C. or therebelow. Maximum temperatures up to 145° C. are particularly preferred and up to 135° C. are very particularly preferred.

The pressure conditions for the process of the present invention are not critical per se. It is possible to employ distinctly reduced pressure, for example 10 to 500 mbar. The process of the present invention can also be carried out at pressures above 500 mbar. Reaction at atmospheric pressure is preferred for reasons of simplicity; however, it is also possible to employ a slightly elevated pressure, for example up to 1200 mbar. It is also possible to employ distinctly elevated pressure, for example pressures up to 10 bar. Reaction at atmospheric pressure is preferred.

The reaction time for the process of the present invention is typically in the range from 10 minutes to 25 hours, preferably in the range from 30 minutes to 10 hours and more preferably in the range from 1 to 8 hours.

After the reaction has ended, the hyperbranched high-functionality polyesters are easy to isolate, for example by filtering off the catalyst and concentrating the filtrate, the concentrating usually being carried out at reduced pressure. Further work-up methods with good suitability are precipitation after addition of water and subsequent washing and drying.

The highly branched or hyperbranched polyesters can further be prepared in the presence of enzymes or decomposition products of enzymes (as described in DE-A 101 63163). The dicarboxylic acids reacted according to the present invention are not acidic organic catalysts within the meaning of the present invention.

It is preferable to use lipases or esterases. Lipases and esterases with good suitability are *Candida cylindracea, Candida lipolytica, Candida rugosa, Candida antarctica, Candida utilis, Chromobacterium viscosum, Geotrichum viscosum, Geotrichum candidum, Mucor javanicus, Mucor miehei*, pig pancreas, *pseudomonas* spp., *pseudomonas fluorescens, Pseudomonas cepacia, Rhizopus arrhizus, Rhizopus delemar, Rhizopus niveus, Rhizopus oryzae, Aspergillus niger, Penicillium roquefortii, Penicillium camembertii* or esterase of *Bacillus* spp. and *Bacillus thermoglucosidasius*. *Candida antarctica* lipase B is particularly preferred. The recited enzymes are commercially available, for example from Novozymes Biotech Inc., Denmark.

The enzyme is preferably used in immobilized form, for example on silica gel or Lewatit®. Methods of immobilizing enzymes are known per se, for example from Kurt Faber, "Biotransformations in organic chemistry", 3rd edition 1997, Springer Verlag, chapter 3.2 "Immobilization" pages 345-356. Immobilized enzymes are commercially available, for example from Novozymes Biotech Inc., Denmark.

The amount of immobilized enzyme used is 0.1% to 20% by weight, in particular 10% to 15% by weight, based on the total mass of the starting materials used and to be reacted.

The process of the present invention is carried out at temperatures above 60° C. It is preferable to employ temperatures of 100° C. or therebelow. Temperatures up to 80° C. are preferred, in the range from 62 to 75° C. are very particularly preferred and in the range from 65 to 75° C. are even more preferred.

The process of the present invention is carried out in the presence of a solvent. Useful solvents include for example hydrocarbons such as paraffins or aromatics. Particularly suitable paraffins are n-heptane and cyclohexane. Particularly suitable aromatics are toluene, ortho-xylene, meta-xylene, para-xylene, xylene in the form of an isomeric mixture, ethylbenzene, chlorobenzene and ortho- and meta-dichlorobenzene. Further very particularly suitable solvents are: ethers such as for example dioxane or tetrahydrofuran and ketones such as for example methyl ethyl ketone and methyl isobutyl ketone.

The amount of solvent added is at least 5 parts by weight, based on the mass of the starting materials used and to be reacted, preferably at least 50 parts by weight and more preferably at least 100 parts by weight. Amounts of more than 10 000 parts by weight of solvent are undesirable since the reaction rate decreases distinctly at distinctly lower concentrations, giving uneconomically long reaction times.

The process of the present invention is carried out at pressures of above 500 mbar. Preference is given to reaction at atmospheric pressure or slightly elevated pressure, for example up to 1200 mbar. It is also possible to employ distinctly elevated pressure, for example pressures up to 10 bar. Reaction at atmospheric pressure is preferred.

The reaction time for the process of the present invention is typically in the range from 4 hours to 6 days, preferably in the range from 5 hours to 5 days and more preferably in the range from 8 hours to 4 days.

After the reaction has ended, the hyperbranched high-functionality polyesters can be isolated, for example by filtering off the enzyme and concentrating the filtrate, in which case the concentrating is typically done at reduced pressure. Further work-up methods with good suitability are precipitation after addition of water and subsequent washing and drying.

The hyperbranched high-functionality polyesters obtainable by the process of the present invention are notable for particularly low contents of discolored and resinified material. See also P. J. Flory, J. Am. Chem. Soc. 1952, 74, 2718 and A. Sunder et al., Chem. Eur. J. 2000, 6, No. 1, 1-8 for definition of hyperbranched polymers. However, "hyperbranched high-functionality" is to be understood as meaning in the context of the present invention that the degree of branching, i.e., the average number of dendritic linkages plus the average number of end groups per molecule is 10-99.9%, preferably 20-99% and more preferably 30-90% (see H. Frey et al. Acta Polym. 1997, 48, 30).

The polyesters of the present invention have a molecular weight $M_w$ of 500 to 50 000 g/mol, preferably 1000 to 20 000, more preferably 1000 to 19 000. The polydispersity is 1.2 to 50, preferably 1.4 to 40, more preferably 1.5 to 30 and most preferably 1.5 to 10. They are typically very soluble in that clear solutions are obtainable in tetrahydrofuran (THF), n-butyl acetate, ethanol and numerous other solvents with up to 50% by weight and in some cases even up to 80% by weight of the polyesters of the present invention, without gel particles detectable by the naked eye.

The hyperbranched high-functionality polyesters of the present invention are carboxyl terminated, carboxyl and hydroxyl terminated and preferably hydroxyl terminated.

The ratios of the highly branched or hyperbranched polycarbonate to the highly branched or hyperbranched polyester are preferably in the range from 1:20 to 20:1, in particular in the range from 1:15 to 15:1 and very particularly in the range from 1:5 to 5:1 when used in admixture.

Suitable metal oxides or semimetal oxides for use as nanoparticles are for example zinc oxide, titanium oxide or silicon oxides. Suitable silicon oxides are for example layered silicates or hydrophobic silicon dioxide, for example Aerosil® R. Zinc oxide being surface modified with silica ($SiO_2$) is also preferred.

The size of the nanoparticles in the thermoplastic polymer material is preferably in the range from 20 to 500 nm and more preferably in the range from 50 to 300 nm in case of substantially spherical nanoparticles. If layered silicates are used, the thickness of the layered silicates is preferably in the range from 1 to 10 nm and the aspect ratio is in the range from 100 to 1000.

In one embodiment, the nanoparticles comprise further additives. The nanoparticles may for example comprise UV stabilizers as additives. Suitable UV stabilizers are for example carbon black, phenols, phosphites, HALS, nanooxides such as Tinuvin1577® from Ciba or Lumogen 4281® from BASF SE.

When the nanoparticles are highly branched or hyperbranched polyesters and/or polycarbonates, these can be coupled to other materials, for example HALS or phenols. Coupling to other materials can be used to influence the properties of the nanoparticles and/or of the thermoplastic polymer material. The highly branched or hyperbranched polycarbonates or highly branched or hyperbranched polyesters generally serve to improve the flow of the thermoplastic polymer. The additives to which the highly branched or hyperbranched polycarbonates and/or highly branched or hyperbranched polyesters are coupled are preferably UV stabilizers and/or lubricants, the lubricants leading for example to a reduction in the coefficient of friction value of the monofilament.

Particularly when the nanoparticles are highly or hyperbranched polycarbonates and/or highly or hyperbranched polyesters, it is further preferable for at least one metal oxide, preferably zinc oxide, to be present also. The metal oxide may be added as an additive to the nanoparticles. Alternatively, the metal oxide is added to the thermoplastic polymer material in the form of nanoparticles also.

When a metal oxide is used as nanoparticle, the metal oxide can be additionally coated. Preferably, the coating applied to the nanoparticles is of a harder material than the nanoparticles. A useful material for the coating is silicon oxide for example. Very particular preference is given to nanoparticles of ZnO with a coating of $SiO_2$.

The application of the coating to the nanoparticles can be effected by any suitable method known to one skilled in the art. Useful methods for applying the coating to the nanoparticles include for example methods wherein the coating material is applied by vapor deposition. Such methods are for example chemical vapor deposition (CVD) processes, physical vapor deposition (PVD) processes. Preferably, however, the coating is applied by sol-gel processes. When nanoparticles of ZnO are coated with $SiO_2$, this is typically done by using a wet process. It is possible here to use the Stöber process for example. Coating is effected in nonaqueous solvent by hydrolysis of tetra-orthosilicates. Alternatively, it is also possible to coat in aqueous solvent wherein a sodium silicate precursor is used. Which method is used depends on the desired film thickness. Comparatively thick layers are preferably produced by coating in an aqueous solvent and to comparatively thin layers by the Stöber process.

The Stöber process is carried out for example by heating a suspension of ZnO in water or some other solvent to 60° C. Then, a tetraorthosilicate is added dropwise for about 20 min and mixed with the ZnO solution at 60° C. for about 1 h. In a subsequent step, a solution of water and ammonia is gradually added over 10 min and a reaction ensues for 3 h at 60° C. To ensure complete reaction, the final step is to carry out a gelling at 80° C. for 3 h. As well as the method described here, however, any other suitable method of coating the nanoparticles can also be used.

When a coating has been applied to the nanoparticles, it is advantageous for the coating to comprise the further additives, for example the UV stabilizers.

The additives, particularly UV stabilizers, in the nanoparticles can migrate to the surface of the monofilament produced. This leads for example to an improvement in the UV stability of the entire monofilament. This can enhance for example the useful life of the product comprising the monofilament. For instance, the durability of an artificial turf produced from the monofilaments is improved.

As well as the highly branched or hyperbranched polyesters and/or polycarbonates and/or the metal oxides it is also possible to use nanoparticles composed of layered silicates or amorphous silicon dioxide. Suitable silicon dioxide particles are preferably produced by sol-gel processes and have a particle size of less than 10 nm, in particular in the range from 5 to 7 nm. Suitable sol-gel processes for producing the nanoparticles from amorphous silicon dioxide are known to one skilled in the art.

In general, suitable nanoparticles of amorphous silicon dioxide have free OH groups at their surface. The pH of the silicon dioxide nanoparticles is preferably less than 10.

Suitable nanoparticles of amorphous silicon dioxide generally have a BET surface area in the range from 150 to 400 $m^2/g$, in particular in the range from 200 to 300 $m^2/g$, for example in the range from 200 to 250 $m^2/g$. The density of the amorphous silicon dioxide is preferably in the range from 1 to 1.5 $g/cm^3$, in particular in the range from 1.1 to 1.2 $g/cm^3$, for example in the range from 1.11 to 1.16 $g/cm^3$.

When nanoparticles composed of amorphous silicon dioxide are used, the proportion of the mass of the thermoplastic molding material which is attributable to nanoparticles composed of amorphous silicon dioxide is in the range from 1% to 10% by weight.

Nanoparticles composed of a metal oxide or of amorphous silicon dioxide typically serve as spacers in relation to a second surface, and thereby reduce the coefficient of friction. At the same time, nanoparticles composed of ZnO, $TiO_2$ or ZrO also offer UV protection. Nanoparticles composed of other metal oxides may for example, as mentioned earlier, have a coating in order that UV protection may be obtained in this way for example.

The nanoparticles are typically admixed to the thermoplastic molding material in the course of the production of pellets intended for further processing, so that the nanoparticles are uniformly distributed in the pellets of thermoplastic molding material. The nanoparticles can either be added in the course of the synthesis of the molding material, or as an additive in the course of the production of the pellets. To obtain the concentration of the nanoparticles which is desired for the product, pellets comprising nanoparticles can be mixed with pellets comprising no nanoparticles in the course of the production of the product.

The further additives which may be present in the thermoplastic molding material are for example any desired admixtures and processing auxiliaries. More particularly, the further additives are dyes, stabilizers or slidants.

For example, the thermoplastic polymer material may comprise as additives 0% to 5% by weight, preferably 0.05% to 3% by weight and particularly 0.1% to 2% by weight of at least one ester or amide of saturated or unsaturated aliphatic carboxylic acids having 10 to 40, preferably 16 to 22 carbon atoms with aliphatic saturated alcohols or amines having 2 to 40, preferably 2 to 6 carbon atoms.

The carboxylic acids may be 1- or 2-basic. Examples are pelargonic acid, palmitic acid, lauric acid, margaric acid, dodecanedioic acid, behenic acid and particularly preferably stearic acid, capric acid and also montanic acid (mixture of fatty acids having 30 to 40 carbon atoms).

The aliphatic alcohols may be 1- to 4-hydric. Examples of alcohols are n-butanol, n-octanol, stearyl alcohol, ethylene glycol, propylene glycol, neopentyl glycol, pentaerythritol, and glycerol and pentaerythritol are preferred.

The aliphatic amines may have 1 to 3 amino groups. Examples thereof are stearylamine, ethylenediamine, propylenediamine, hexamethylenediamine, di(6-aminohexyl) amine, of which ethylenediamine and hexamethylenediamine are particularly preferred. Preferred esters or amides are accordingly glycerol distearate, glycerol tristearate, ethylenediamine distearate, glycerol monopalmitate, glycerol trilaurate, glycerol monobehenate and pentaerythritol tetrastearate.

It is also possible to use mixtures of various esters or amides or esters with amides in combination, in which case the mixing ratio is freely choosable.

Further customary additives are for example, in amounts up to 40% by weight, preferably up to 30% by weight, elastomeric addition polymers which are often also referred to as impact modifiers, elastomers or rubbers.

In general, they comprise addition copolymers which are preferably constructed of at least two of the following monomers: ethylene, propylene, butadiene, isobutene, isoprene, chloroprene, vinyl acetate, styrene, acrylonitrile and acrylic or methacrylic esters having 1 to 18 carbon atoms in the alcohol component.

Such polymers are described for example in Houben-Weyl, Methoden der organischen Chemie, vol. 14/1 (Georg-Thieme-Verlag, Stuttgart, 1961), pages 392 to 406 and in the monograph by C. B. Bucknall, "Toughened Plastics" (Applied Science Publishers, London, 1977).

In what follows, some preferred kinds of such elastomers are presented.

Preferred kinds of such elastomers are the ethylene-propylene monomer (EPM) and ethylene-propylene-diene monomer (EPDM) rubbers.

EPM rubbers generally have virtually no double bonds left over, while EPDM rubbers can have 1 to 20 double bonds/100 carbon atoms.

Useful diene monomers for EPDM rubbers include for example conjugated dienes such as isoprene and butadiene, nonconjugated dienes having 5 to 25 carbon atoms such as penta-1,4-diene, hexa-1,4-diene, hexa-1,5-diene, 2,5-dimethylhexa-1,5-diene and octa-1,4-diene, cyclic dienes such as cyclopentadiene, cyclohexadienes, cyclooctadienes and dicyclopentadiene and also alkenylnorbornenes such as 5-ethylidene-2-norbornene, 5-butylidene-2-norbornene, 2-methallyl-5-norbornene, 2-isopropenyl-5-norbornene and tricyclodienes such as 3-methyltricyclo(5.2.1.0.2.6)-3,8-decadiene or mixtures thereof. Preference is given to hexa-1,5-diene, 5-ethylidenenorbornene and dicyclopentadiene. The diene content of the EPDM rubbers is preferably 0.5% to 50% and particularly 1% to 8% by weight, based on the total weight of the rubber.

EPM and EPDM rubbers may preferably also be grafted with reactive carboxylic acids or derivatives thereof. Examples are acrylic acid, methacrylic acid and derivatives thereof, for example glycidyl (meth)acrylate, and also maleic anhydride.

A further group of preferred rubbers are copolymers of ethylene with acrylic acid and/or methacrylic acid and/or the esters of these acids. Additionally, the rubbers may further comprise dicarboxylic acids such as maleic acid and fumaric acid or derivatives of these acids, for example esters and anhydrides, and/or epoxy-containing monomers. These dicarboxylic acid derivatives and epoxy-containing monomers are preferably incorporated in the rubber by addition of respectively dicarboxylic acid monomers and epoxy-containing monomers of the general formulae I or II or III or IV to the monomer mixture (I)

$$R^1C(COOR^2)=C(COOR^3)R^4$$

(II)

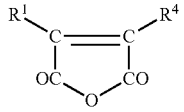

(III)

$$CHR^7=CH-(CH_2)_m-O-(CHR^6)_g-\underset{\diagdown O \diagup}{CH-CHR^5}$$

(IV)

$$CH_2=CR^9-COO-(CH_2)_p-\underset{\diagdown O \diagup}{CH-CHR^8}$$

where $R^1$ to $R^9$ are each hydrogen or alkyl having 1 to 6 carbon atoms, m is a whole number from 0 to 20, g is a whole number from 0 to 10 and p is a whole number from 0 to 5.

Preferably, the $R^1$ to $R^9$ radicals are each hydrogen with m being 0 or 1 and g being 1. The corresponding compounds are maleic acid, fumaric acid, maleic anhydride, allyl glycidyl ether and vinyl glycidyl ether.

Preferred compounds of the formulae I, II and IV are maleic acid, maleic anhydride and epoxy-containing esters of acrylic acid and/or methacrylic acid, such as glycidyl acrylate, glycidyl methacrylate and the esters with tertiary alcohols, such as t-butyl acrylate. True, the latter have no free carboxyl groups, but their behavior resembles that of the free acids and they are therefore referred to as monomers having latent carboxyl groups.

Advantageously, the copolymers consist of 50% to 98% by weight of ethylene, 0.1% to 20% by weight of epoxy-containing monomers and/or methacrylic acid and/or monomers comprising acid anhydride groups, the remainder being (meth)acrylic esters.

Particular preference is given to copolymers formed from 50% to 98%, in particular 55% to 95% by weight of ethylene, 0.1% to 40%, in particular 0.3% to 20% by weight of glycidyl acrylate and/or glycidyl methacrylate, (meth)acrylic acid and/or maleic anhydride, and 1% to 45%, in particular 10% to 40% by weight of n-butyl acrylate and/or 2-ethylhexyl acrylate.

Further preferred esters of acrylic and/or methacrylic acid are the methyl, ethyl, propyl, i-butyl and t-butyl esters.

Besides these it is also possible to use vinyl esters and vinyl ethers as comonomers.

The ethylene copolymers described above are obtainable by following conventional processes, preferably by random copolymerization under high pressure and elevated temperature. Appropriate processes are general common knowledge.

Preferred elastomers are also emulsion polymers, the preparation of which is described for example by Blackley in the monograph "Emulsion Polymerization". Useful emulsifiers and catalysts are known per se.

In principle, elastomers having a homogeneous construction or alternatively elastomers having a shell construction can be used. The shell-type construction is determined by the order of addition of the individual monomers; the morphology of the polymers is also influenced by this order of addition.

Useful monomers for preparing the rubber part of the elastomer include by way of illustration acrylates such as for example n-butyl acrylate and 2-ethylhexyl acrylate, corresponding methacrylates, butadiene and isoprene and also mixtures thereof. These monomers can be copolymerized with further monomers such as for example styrene, acrylonitrile, vinyl ethers and further acrylates or methacrylates such as methyl methacrylate, methyl acrylate, ethyl acrylate and propyl acrylate.

The soft or rubber phase (having a glass transition temperature of below 0° C.) of the elastomers may constitute the core, the outer envelope or an intermediate shell (in the case of elastomers constructed with more than two shells); elastomers having more than one shell may also have two or more shells consisting of a rubber phase.

When one or more hard components (having glass transition temperatures above 20° C.) are involved, besides the rubber phase, in the construction of the elastomer, these are generally prepared by polymerization of styrene, acrylonitrile, methacrylonitrile, α-methylstyrene, p-methylstyrene, acrylic esters and methacrylic esters such as methyl acrylate, ethyl acrylate and methyl methacrylate as principal monomers. Besides these, it is also possible to use minor proportions of further comonomers.

It will prove advantageous in some cases to use emulsion polymers which have reactive groups at the surface. Such groups are for example epoxy, carboxyl, latent carboxyl, amino or amide groups and also functional groups which may be introduced by concomitant use of monomers of the general formula

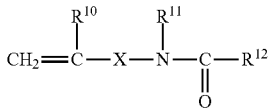

where $R^{10}$ is hydrogen or a $C_1$- to $C_4$-alkyl group, $R^{11}$ is hydrogen, a $C_1$- to $C_8$-alkyl group or an aryl group, in particular phenyl, $R^{12}$ is hydrogen, a $C_1$- to $C_{10}$-alkyl group, a $C_6$- to $C_{12}$-aryl group or —$OR^{13}$ $R^{13}$ is a $C_1$- to $C_{12}$-alkyl or $C_6$- to $C_{12}$-aryl group, each optionally substituted with O— or N-containing groups, X is a chemical bond, a $C_1$- to $C_{10}$-alkylene or $C_6$-$C_{12}$-arylene group or

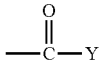

Y is O—Z or NH—Z and

Z is a $C_1$- to $C_{10}$-alkylene or $C_6$- to $C_{12}$-arylene group. Similarly, the graft monomers described in EP-A 208 187 are suitable for introducing reactive groups at the surface.

Further examples are acrylamide, methacrylamide and substituted esters of acrylic acid or methacrylic acid such as (N-t-butylamino)ethyl methacrylate, (N,N-dimethylamino) ethyl acrylate, (N,N-dimethylamino)methyl acrylate and (N,N-diethylamino)ethyl acrylate.

The particles of the rubber phase can also be in a crosslinked state. Examples of crosslinking monomers are 1,3-butadiene, divinylbenzene, diallyl phthalate and dihydrodicyclopentadienyl acrylate and also the compounds described in EP-A 50 265.

It is also possible to use so-called graft-linking monomers, i.e., monomers having two or more polymerizable double bonds which react at different rates during the polymerization. Preference is given to using such compounds in which at least one reactive group polymerizes at about the same rate as the other monomers, while the other reactive group (or reactive groups), for example, polymerize(s) distinctly more slowly. The different polymerization rates give rise to a certain proportion of double-bond unsaturation in the rubber. When another phase is then grafted onto a rubber of this type, at least some of the double bonds present in the rubber react with the graft monomers to form chemical bonds, i.e., the phase grafted on has at least some degree of chemical bonding to the grafting base.

Examples of such graft-linking monomers are monomers comprising allyl groups, in particular allyl esters of ethylenically unsaturated carboxylic acids such as allyl acrylate, allyl methacrylate, diallyl maleate, diallyl fumarate, diallyl itaconate or the corresponding monoallyl compounds of these dicarboxylic acids. Besides these there is a multiplicity of further suitable graft-linking monomers; see US. Pat. No. 4,148,846 for example for further details.

The proportion of these crosslinking monomers in the impact-modifying polymer is generally up to 5% by weight and preferably not more than 3% by weight, based on the impact-modifying polymer.

Some preferred emulsion polymers are listed below. The list first mentions graft polymers having a core and at least one outer shell, which have the following construction:

| Type | Monomers for core | Monomers for envelope |
|---|---|---|
| I | 1,3-butadiene, isoprene, n-butyl acrylate, ethylhexyl acrylate or mixtures thereof | styrene, acrylonitrile, methyl methacrylate |
| II | as I, but with concomitant use of crosslinkers | as I |
| III | as I or II | n-butyl acrylate, ethyl acrylate, methyl acrylate, 1,3-butadiene, isoprene, ethylhexyl acrylate |
| IV | as I or II | as I or III, but with concomitant use of monomers having reactive groups, as described herein |
| V | styrene, acrylonitrile, methyl methacrylate or mixtures thereof | first envelope from monomers as described under I and II for the core, second envelope as described under I or IV for the envelope |

These graft polymers, in particular ABS and/or ASA polymers, are preferably used in amounts of up to 40% by weight for the impact modification of PBT, if appropriate in admixture with up to 40% by weight of polyethylene terephthalate. Blend products of this type are obtainable under the trademark of Ultradur®S (formerly Ultrablend®S from BASF AG).

Instead of graft polymers constructed with more than one shell, it is also possible to use homogeneous, i.e., single-shell, elastomers composed of 1,3-butadiene, isoprene and n-butyl acrylate or copolymers thereof. These products, too, may be prepared by concomitant use of crosslinking monomers or monomers having reactive groups.

Examples of preferred emulsion polymers are n-butyl acrylate-(meth)acrylic acid copolymers, n-butyl acrylate-glycidyl acrylate or n-butyl acrylate-glycidyl methacrylate copolymers, graft polymers having an inner core of n-butyl acrylate or based on butadiene and an outer envelope of the aforementioned copolymers and copolymers of ethylene with comonomers which supply reactive groups.

The elastomers described may also be prepared by other customary methods, for example by suspension polymerization.

Silicone rubbers as described in DE-A 37 25 576, EP-A 235 690, DE-A 38 00 603 and EP-A 319 290 are likewise preferred.

It will be appreciated that it is also possible to use mixtures of the above-recited types of rubber.

Furthermore, additives present may comprise customary processing auxiliaries for thermoplastic polymer materials, such as stabilizers, oxidation retarders, agents to counteract decomposition due to heat and decomposition due to ultraviolet light, lubricating and demolding agents, colorants such as dyes and pigments, nucleating agents, plasticizers, etc.

Examples which may be mentioned of oxidation retarders and heat stabilizers are sterically hindered phenols and/or phosphites, hydroquinones, aromatic secondary amines such as diphenylamines, various substituted representatives of these groups and mixtures thereof in concentrations up to 1% by weight, based on the weight of the thermoplastic molding materials.

UV stabilizers which may be mentioned and are generally used in amounts of up to 2% by weight, based on the molding material, are various substituted resorcinols, salicylates, benzotriazoles and benzophenones.

Colorants which may be added are inorganic pigments, such as titanium dioxide, ultramarine blue, iron oxide and carbon black, and also organic pigments, such as phthalocyanines, quinacridones, perylenes and also dyes, such as nigrosine and anthraquinones.

Nucleating agents which may be used are sodium phenylphosphinate, alumina, silica and preferably talc.

Further lubricating and demolding agents are typically used in amounts up to 1% by weight. They are preferably long-chain fatty acids (for example stearic acid or behenic acid), their salts (for example calcium stearate or zinc stearate) or montan waxes (mixtures of straight-chain, saturated carboxylic acids having chain lengths of 28 to 32 carbon atoms) and also calcium montanate and sodium montanate and also low molecular weight polyethylene and polypropylene waxes.

Examples of plasticizers are dioctyl phthalate, dibenzyl phthalate, butyl benzyl phthalate, hydrocarbon oils, N-(n-butyl)benzenesulfonamide.

The molding materials of the present invention may further comprise from 0% to 2% by weight of fluorine-containing ethylene polymers. These are polymers of ethylene which have a fluorine content in the range from 55% to 76% by weight and preferably in the range from 70% to 76% by weight.

Examples thereof are polytetrafluoroethylene (PTFE), tetrafluoroethylene-hexafluoro-propylene copolymers or tetrafluoroethylene copolymers having minor proportions (in general up to 50% by weight) of copolymerizable ethylenically unsaturated monomers. These are described for example by Schildknecht in "Vinyl and Related Polymers", Wiley, 1952, pages 484 to 494 and by Wall in "Fluoropolymers" (Wiley Interscience, 1972).

These fluorine-containing ethylene polymers have a homogeneous distribution in the molding materials and preferably have a number average particle size $d_{50}$ in the range from 0.05 to 10 μm, in particular 0.1 to 5 μm. These small particle sizes are particularly preferably obtainable by using aqueous dispersions of fluorine-containing ethylene polymers and their incorporation into a polyester melt.

The thermoplastic molding materials of the present invention are obtainable according to conventional processes wherein the starting components are mixed in conventional mixing apparatuses such as screw extruders, Brabender mills or Banbury mills and subsequently extruded. After extrusion, the extrudate can be cooled and comminuted. It is also possible to premix individual components and then to add the remaining starting materials individually and/or likewise in the form of a mixture. The mixing temperatures are generally in the range from 230 to 290° C.

The individual components of the thermoplastic polymer material can be premixed and then added to an extruder. It was also possible to mix for example only two or a portion of the components and to add the remaining components separately. The components are typically added via one inlet aperture into the extruder. Alternatively, it is also possible to add the individual components via two or more inlet apertures for example.

In the extruder, the polyester is melted and mixed with the other components. At the same time, the molding material undergoes homogenization. To melt the polyester, the extruder is heated. Heating typically takes place in the jacket of the extruder.

Any extruder known to one skilled in the art can be used. For instance, single- or multi-screw extruders can be used. Single- or two-screw extruders are customary. However, extruders having a planetary arrangement for the screws are also conceivable for example. In the case of two-screw extruders, it is customary for the screws to mesh with each other. The screws may rotate in the same direction or in opposite directions.

An extruder used for producing monofilaments typically includes three or more zones. A feed zone, in which the added components are mixed and compressed; a melting and homogenizing zone; and an ejection zone. The ejection zone terminates in a molding tool through which the molten polymer material is pressed. The molding tool comprises two or more spinneret dies through which the monofilaments are pressed. The individual monofilaments thus produced are subsequently stretched in a manner known to one skilled in the art. For this, it is typical for example to lead the monofilaments via a take-off device, the take-off device having a higher conveying speed than the exit speed from the extruder. Alternatively, it is also possible first to provide a take-off device which has a customary speed and downstream thereof to provide faster means for transporting the monofilament, so that the monofilament undergoes stretching as a result of the increasing speed. For this, the monofilament can be guided for example between two counterrotating rolls. In the course of stretching, the circumferential speed of the rolls increases. The monofilaments are typically stretched after the strand extrudate has cooled. Cooling typically takes place in a water bath. However, liquids other than water are also conceivable to cool the monofilament. Cooling in air is also possible.

After stretching, the monofilaments thus produced are heat-conditioned. The heat-conditioning removes stresses in the monofilament. The monofilament becomes stabilized as a result. Heat-conditioning is done at a temperature in the range from 40 to 120° C., preferably at a temperature in the range from 60 to 100° C. and particularly at a temperature in the range from 70 to 90° C. The monofilament is typically maintained for a period in the range from 0.01 to 5 min, preferably in the range from 0.02 to 3 min and particularly in the range from 0.03 to 0.1 min.

The monofilaments thus produced are used for example to produce artificial turf. To produce artificial turf, individual monofilaments are tufted together and subsequently cut to the desired length.

The monofilaments produced can also be used to produce for example surfaces for artificial ski slopes, as playground surfaces or as surfaces for slides. For this purpose, the monofilaments are either tufted together as for the artificial turf, or alternatively it is also possible to produce woven fabrics.

Furthermore, the monofilaments produced according to the present invention can also be used in the manufacture of wigs. Wigs are typically manufactured by knotting techniques.

Similarly, the monofilaments produced according to the present invention are also useful in the manufacture of soft or stiff brushes.

More particularly, however, the monofilaments are useful in the manufacture of artificial turf, as a surface for artificial ski slopes, as a playground surface or for slides. The particular utility is particularly due to the good bend recovery and the low coefficient of friction value of the thermoplastic polymer material used for producing the monofilaments.

The invention claimed is:

1. A process for producing at least monofilament from a thermoplastic polymer material comprising at least one polyester, nanoparticles and optionally further additives, said process comprising adding the at least one polyester, nanoparticles and optionally further additives to an extruder as partial or complete mixtures or separately and the thermoplastic polymer material being initially strand extruded, cooled and stretched and finally heat-conditioned at a temperature in the range from 40 to 120° C. for 0.01 to 10 min., wherein the nanoparticles comprise materials selected from the group consisting of highly branched or hyperbranched polycarbonates having an OH number of 1 to 600 mg KOH/g polycarbonate (to DIN 53240 Part 2), highly branched or hyperbranched polyesters of the type $A_xB_y$ where x is at least 1.1 and y is at least 2.1, and mixtures thereof, mixed with metal oxides, semimetal oxides, or mixtures thereof, and wherein the nanoparticles optionally comprise further additives, and wherein a coating is applied atop the nanoparticles.

2. The process according to claim 1 wherein the at least one polyester is polyethylene terephthalate, polypropylene terephthalate, polybutylene terephthalate or a mixture thereof.

3. The process according to claim 1, wherein the metal oxide is zinc oxide, titanium oxide, or a mixture thereof.

4. The process according to claim 1 wherein the semimetal oxide is present and is amorphous silicon dioxide or layered silicate.

5. The process according to claim 1 wherein the further additives in the nanoparticles are present and are UV stabilizers.

6. The process according to claim 1, wherein the coating comprises further additives.

7. The process according to claim 1, wherein the coating comprises a metal oxide.

8. The process according to claim 7, wherein the metal oxide in the coating is zinc oxide.

9. The process according to claim 1, wherein the coating comprises silicon dioxide.

10. The process according to claim 1 wherein the further additives are present in the thermoplastic polymer material and are dyes, stabilizers or slidants.

11. A monofilament obtained by the process according to claim 1.

12. An artificial turf, a wig or a bristle for soft or stiff brushes which comprises the monofilament as claimed in claim 11.

* * * * *